United States Patent [19]

Fredriksson et al.

[11] 4,047,464

[45] Sept. 13, 1977

[54] UMBILICAL CORD BREAKER

[75] Inventors: Lars Evert Fredriksson, Vreta Kloster; Gunnar Jacobson; Olof Bertil Olsson, both of Karlskoga, all of Sweden

[73] Assignee: AB Bofors, Bofors, Sweden

[21] Appl. No.: 653,325

[22] Filed: Jan. 29, 1976

[30] Foreign Application Priority Data

Feb. 19, 1975 Sweden ..... 7501822

[51] Int. Cl.[2] ..... H01R 13/62; F41F 3/04

[52] U.S. Cl. ..... 89/1.811; 339/45 M

[58] Field of Search ..... 339/45, 46; 89/1.811

[56] References Cited

U.S. PATENT DOCUMENTS

| | | | |
|---|---|---|---|
| 2,951,421 | 9/1960 | Katzen | 339/46 X |
| 3,072,021 | 1/1963 | Marcon | 339/45 M X |
| 3,122,403 | 2/1964 | McKee et al. | 339/45 M |
| 3,136,842 | 6/1964 | Perkins et al. | 339/45 M X |
| 3,611,274 | 10/1971 | Katzin | 89/1.811 X |

*Primary Examiner*—Roy Lake
*Assistant Examiner*—Neil Abrams
*Attorney, Agent, or Firm*—Pollock, Vande Sande & Priddy

[57] ABSTRACT

An improved device for breaking the connection between an electric control system and a missile by separating a control cable or umbilical cord joining the missile to its launcher housing during launch. A plurality of continuous, flexible conductors are passed through openings in a non-conductive insert in the surface of the missile. Because the conductors are secured to both the missile and the housing on opposite sides of the insert, they are tensioned against and bent over the outer edge of the opening during launch and broken due to the concentration of tensile and bending stress at the point of contact.

15 Claims, 3 Drawing Figures

UMBILICAL CORD BREAKER

BACKGROUND OF THE INVENTION

Defense activities often include attacking of enemy targets using guided projectiles or missiles. During storage and handling prior to launch, the missile is usually kept in a missile container, which also serves as a launching tube. While the missile is in the missile container, it is connected by an electric cable with the missile container and a control unit for the missile. This cable transmits electric signals to the missile while the missile is in storage to test its various functions. When the missile is used in field service, this cable transmits the necessary starting signals to the missle. When the missile has been started, this cable connection must be broken in such a way that, after said breaking, no remnants of the cable will be dragged along by the missile. Because of the high velocity of the missile, its aerodynamic properties are seriously affected if the contact device in the missile has an influence on the air flow around the missile, which is smooth in other respects.

In the missiles available in the market, two kinds of separating mechanisms are known for breaking the electric cable connection. One kind consists of extractable contact devices; and the other, of so-called guillotine devices for the cable.

The extractable contact device usually consists of a connection by contacts made between the missile and the missile container. The contact device is placed at the rear of the missile in such a way that male and female contacts are located axially parallel to the axis of the missile. When the missile is launched and moves forward in the missile container, the male contact will automatically be pulled out of the female contact, thereby breaking the connection between the missile and the missile container. Such contact devices are not suitable for use in missiles equipped with a separate booster motor which can be jettisoned in flight. If such a contact device is used, in this case, a further contact connection must be provided between the booster motor and the rear surface of the missile. The further contact is broken when the booster motor is jettisonal.

The guillotine devices consist essentially of two nonconductive plates which can slide in relation to each other, and are provided with through holes at right angles to the direction in which they slide. The cable between the missile and the missile container can be passed through one such hole, or specific electrical conductors in the cable can be passed through separate holes. When the missile is started and the electric cable connection is to be broken, one of the plates is caused to move in relation to the other one, for instance by means of an electrically activated powder activator, thereby breaking electrical connection.

Both of these previously known devices, particularly with respect to small missiles, have the disadvantage that they take up too much space and are too heavy in relation to the other parts of the missile. Moreover, for the guillotine devices, a separate electric impulse is required to carry out the electrical separation. For male-female contacts which are pulled out when the missile starts, no special separating signal need be transmitted, but such contacts have the disadvantage that they must be placed at the rear of the missile.

OBJECTS AND SUMMARY OF THE INVENTION

The purpose of the present invention is to provide a electrical connector which eliminate these disadva tages. According to the invention the device compris an insert made of electrically non-conducted materi located in the wall of the missile. The insert is provide with a number of through holes to accommodate th various conductors located in the electric cable conne tion. When the missile begins to move forward in th missile container, these conductors be bent over th outer edges of the through holes, so that the tensi stresses occurring in the conductors are added to th bending stresses at the point where the respective co ductor is bent over the outer edge of the hole. Th concentration of stress at this point causes the condu tor to break, thus producing a smooth outer surface o the missile where the breaking takes place.

The insert in the wall of the missile is arranged in suc a way that its outer surface constitutes a part of th envelope surface of the missile and fits flush with th surface. The electric cable is anchored in securing d vices in both the missile and the missile container so th when the missile starts the cable will be straight an nearly parallel to the longitudinal axis of the missile, an will not be bent at any place other than just over th outer edge of the through holes. The electrical condu tors of the cable will then be broken off at the envelop surface of the missile.

BRIEF DESCRIPTION OF THE DRAWINGS

In the following, the invention will be described i more detail, with reference to the accompanying draw ings, which show an appropriate embodiment of th invention.

DETAILED DESCRIPTION OF A PREFERRED EMBODIMENT

Figure 1:
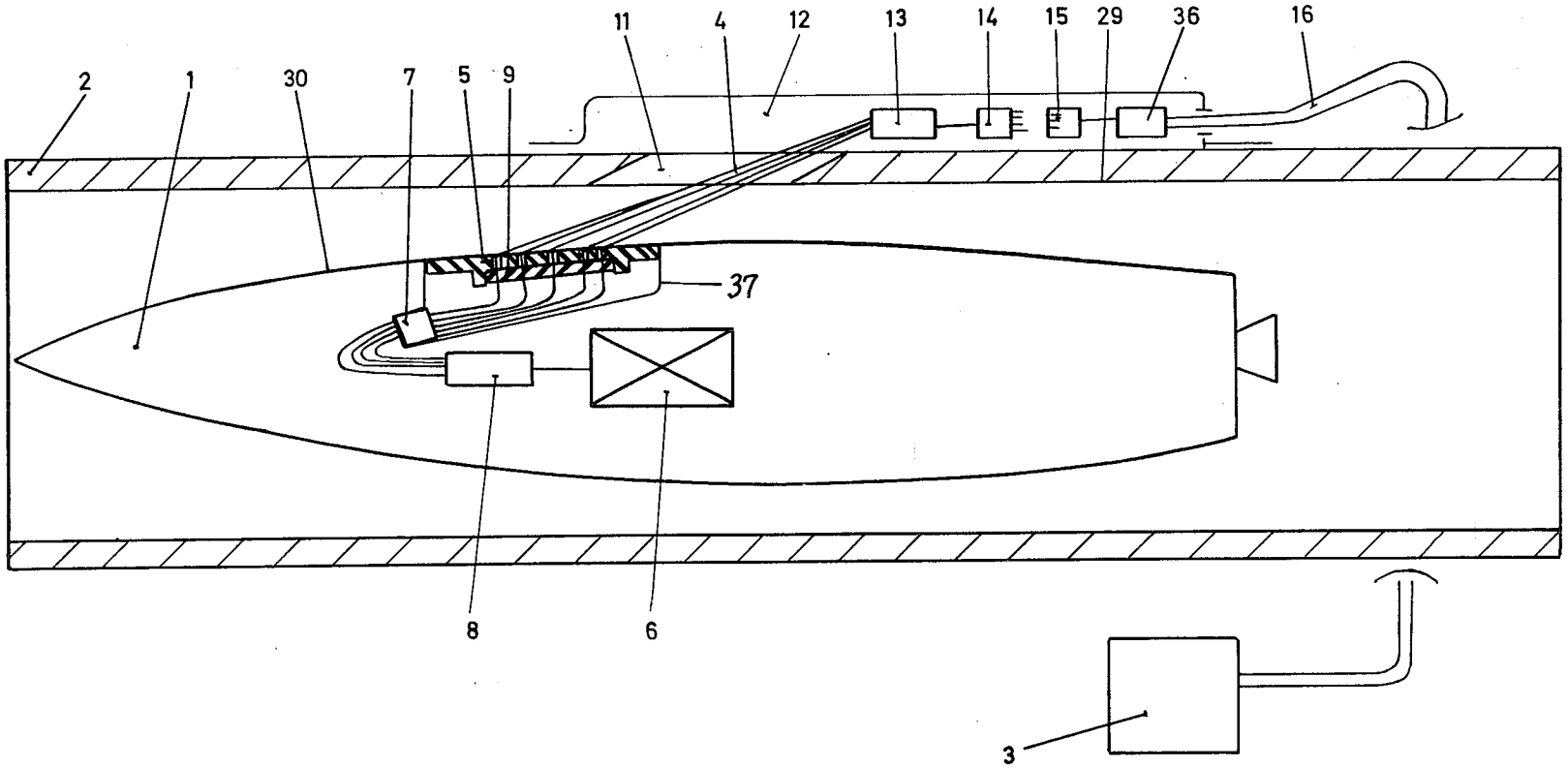
FIG. 1 shows schematically the electric cable be tween a missile and its missile container.

Guided projectiles or missiles are used in variou defense situations for attacking movable targets. Refer ring to FIG. 1, a missile weapon typically comprise three parts: a guided projectile, such as the missile 1; storage container 2 for the missile, which also serves a a launching tube; and a missile control unit 3. Befor launch, the missile 1 is placed in the missile container 2 and is secured mechanically by means of a missle locl (not shown). Missile 1 is connected with missile con tainer 2 by means of an electric cable 4, a so-callec umbilical cord which extends across an open annulu separating missile 1 from container 2, as shown Through cable 4, electric signals may be sent to missil 1 when it is in storage to test its function. When missil 1 is used under field service conditions, cable 4 transmit the required starting signals to missile 1 from the con trol unit 3. When missile 1 starts, the cable 4 is broken and missile 1 is guided toward its target automatically or with the aid of an operator. Cable 4 comprises a group of separate electrical conductors. The number o conductors can vary, depending on the number of con trol signals to be transmitted to missile 1. In FIG. 1, a cable comprising five separate electrical conductors has been chosen as an example.

The conductors pass through an insert 5, the so-called umbilical cord breaker, which constitutes a part of the envelope surface of missile 1, and is placed in the vicinity of the electronic part of the missile, which has been indicated schematically by the block 6. The conductors pass through an electric disturbance filter 7 which is joined to insert 5 by a screen wall 37. Filter 7 screens the missile from external high frequency disturbances. A terminal bar 8 joins the conductors to electronic part 6. The screen wall 37, in turn, is connected with the casing of the missile, which is also made of an electrically conductive material. The conductors are secured mechanically to insert 5 by means such as a body 9 of thermosetting resin, into which the individual conductors have been cast. In order to prevent the conductors from sliding in the material of block 9, they can be made with an enlarged portion such as a knot, loop or the like 10 (see FIG. 2) cast in the thermosetting resin.

Cable 4 is led out through a hole 11 in missile container 2 to a junction box 12 on the outer wall of the missile container. Junction box 12 encloses a securing device 13 which anchors cable 4 to the wall of the missile container, and a removable contact device in the form of a male contact 14 connected with the cable 4 and a female contact 15 connected to control unit 3 by a securing device 36 and a cable 16.

Figures 2, 3:
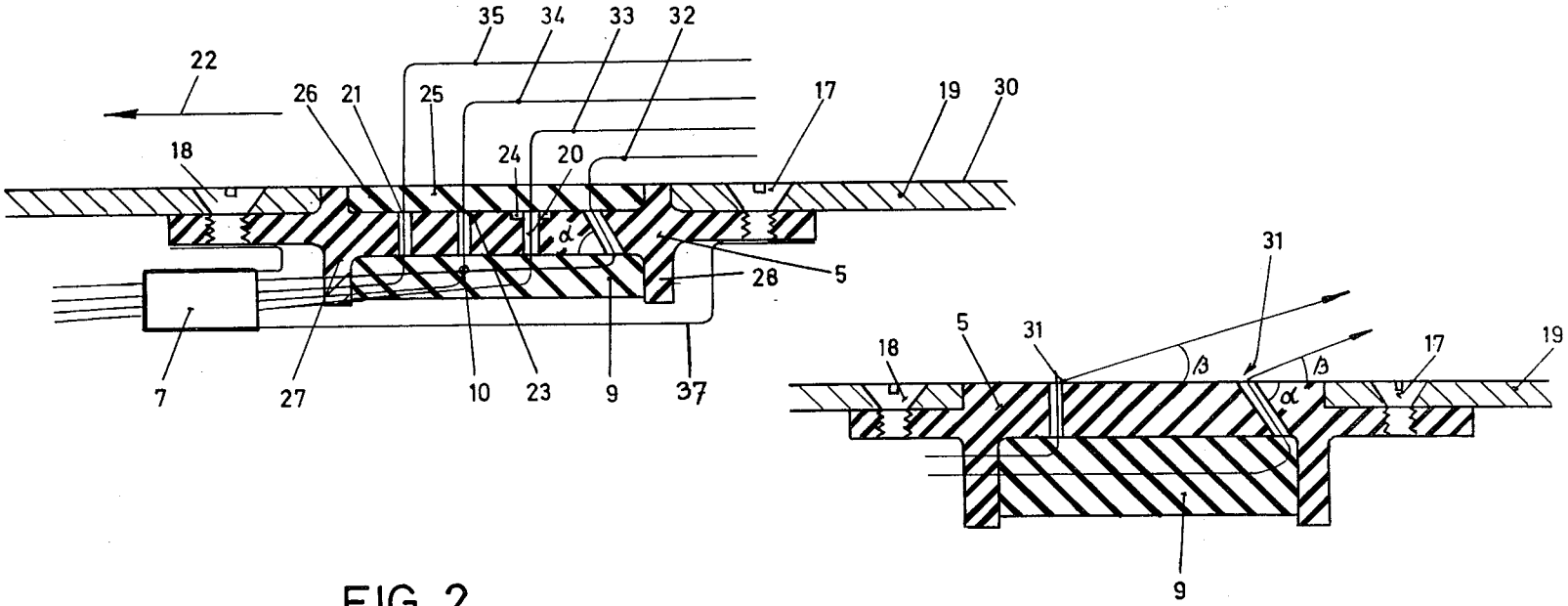
FIG. 2 shows a detailed view of the insert, or umbili cal cord breaker, which effects the breaking of the elec trical conductors at the place desired.
FIG. 3 shows a view of the electrical conductors c the cable just before breaking.

FIG. 2 shows in more detail the appearance of the so-called umbilical cord breaker 5, which comprises a body made of electrically non-conductive material. Breaker 5 is screwed into place by means of screws 17, 18 passing through the outer casing 19 of the missile so that it constitutes a part of the envelope surface of the missile. The breaker 5 also is provided with through holes 20 for the individual conductors. These holes may be drilled at right angles to the envelope surface or at an oblique angle. In the latter case, the outlet opening of the oblique hole is located farther towards the front of the missile than the opening of the hole at the inside of breaker 5, as illustrated. The center line through the hole will thereby form an angle $\alpha$ to the envelope surface of the missle which is less than 90°. In FIG. 2, the arrow 22 indicates the direction of travel of the missile. It is essential that the material of breaker 5 is not only electrically non-conductive, but also is hard. Moreover, it is essential that the outlet openings 21 have sharp edges 23. In order to optimize the cutting edge effect, that is, to ensure that the edge at the outlet opening is sufficiently sharp to achieve the cutting of the conductors, breaker 5 can be provided with metal inserts 24 surrounding openings 21, each metal insert being electrically insulated from the other metal inserts. In FIG. 2, one of the holes is shown with such a metal insert 24.

As mentioned above, the umbilical cord breaker constitutes a part of the envelope surface of the missile, and it is essential that its outer surface 25 fits in well with the outer surface of the missile. The purpose of the umbilical cord breaker 5 is to insure that when the missile starts, the conductors of cable 4 will be broken immediately at the envelope surface. Due to the high velocities which missiles of this kind attain in flight, any unevenness on the envelope surface of the missile can cause very great disturbances of the aerodynamics around the missile body. It has been shown that cable stubs protruding only a few millimeters can have a disturbing effect. When the conductors are broken off, it may happen that the actual electrical conductor is broken off at one place and the insulation at another place. In such a situation small remnants of the insulation can protrude from holes in the umbilical cord breaker. As these insulation remnants are comparatively short, it is possible to cope with them by not allowing the hard material of the umbilical cord breaker to extend all the way out to the envelope surface of the missile, but to allow the part of the outermost layer where the holes 20 emerge consist of a soft thermosetting resin 26 of the silicone rubber type, for example the soft resin does not have any detrimental influence on the cutting edge effect at the mouth of the hole, but can hide effectively any insulation remnants. As will be noted from FIG. 2, thermosetting resin 26 fits well into the outer surface of the missile. Through this soft thermosetting resin it is moreover possible to make the cable gland airtight both before and after the breaking off, which is desirable from an aerodynamic point of view. FIG. 3 shows an alternative embodiment, in which the hard material of breaker 5 extends all the way out to and is flush with the outer surface of the missile. Breaker 5 is moreover provided with flanges 27, 28 extending into the internal parts of the missile, which facilitates the casting of the cables in the thermosetting resin 9.

When the missile starts, the umbilical cord breaker functions in the following way. As the missile moves out of container 2 in the direction of the arrow 22, cable 4 will be stretched out between the two securing devices, the device 13 in the missle container and the device 9 in the missle. It is then essential that the transmission of the strictly tensile stress which arises in the cable between the two securing devices takes place in such a way that the electrical conductors in the cable are not subjected to anything but strictly a tensile stress at any point other than just at the edge of the outlet hole 21. That is, to the greatest possible extent cable 4 is straight when it is stretched out, and is not bent at any point other than just over the cutting edge 23. Just before the missile starts, the conductors assume a position according to FIG. 2, where they pass into the missile substantially at right angles to the envelope surface of the missile, but just after the missile has started they will extend as shown in FIG. 3. If the difference in diameter between the inside 29 of the missile container and the outside 30 of the missile is comparatively small, and the length of the cable is great, the angle $\beta$ which the conductors form to the envelope surface of the missile when extended will be relatively small as the missile leaves the container. When the conductors are extended, the straight part of the cable will be subjected to a strictly tensile stress, while at the outlet openings 21 in the breaker the conductors will be bent over the sharp edge 23, whereby the conductors at this point will be subjected to both tensile stress and bending stress. The conductors will thereby reach the breaking stress only at point 31, which will be the point where the cable connection breaks and is torn off. With an appropriate choice of the parameters involved, it is possible to achieve that the tensile strength at the point 31 will be only about half as great as the tensile strength in the straight part of the conductors.

In order to achieve the breaking effect desired, it is more advantageous to have a cable with few conductors than a cable with many conductors. It is moreover more advantageous to have a brittle electrical conductor than a tough conductor. Hard drawn copper, for instance, is more appropriate than annealed copper. The cable insulation should be brittle-hard, rather than soft.

The angle $\beta$ at which the cable leaves the envelope surface of the missile when stretched out in connection with the start of the missile should be as little as possible, at the same time as the angle $\alpha$, i.e. the angle between the hole 20 and the longitudinal axis of the missile should also be as small as possible. This involves that the efficient cutting edge angle chosen $\alpha + \beta$ should be as small as possible.

In order to facilitate the breaking of the cable, which can comprise a great number of individual electrical conductors, the conductors are arranged in such a way that when the missile starts, all of the wires are not stretched out simultaneously. It is advisable to have the individual conductors of different lengths, so that the stretching out takes place successively. In FIG. 2 it can, for instance, be the conductor 32 which is first stretched out so that it breaks. When this wire has been broken off, the conductor 33 is stretched out, and when this has been broken the conductor 34 is stretched out, thereafter the conductor 35 and so forth. This gives the advantage that the mechanical securing devices 9 and 13 as well as the actual umbilical cord breaker need not simultaneously withstand the total force required to break all of the electrical conductors. The conductors are therefore broken off one at a time, about like when a paper is torn.

The invention is not limited to the embodiment shown above as an example, but can be subject to modifications within the scope of the following claims.

We claim:

1. Apparatus for breaking a plurality of continuous, flexible electrical conductors which connect a missile having an outer wall to a missile container, during launch of said missile from said container, comprising:

first means for securing one end of each of said continuous, flexible conductors in said missile container;

second means spaced from said first means for securing the other end of each of said continuous flexible conductors in said missile, so that said continuous flexible conductors extend across an open annulus separating said missile from said missile container;

an insert of electrically non-conductive material mounted in said outer wall of said missile and spaced from said container with said continuous flexible conductors extending through said annulus;

a plurality of holes, each having a diameter larger than the diameter of at least one of said continuous flexible conductors, extending through said insert through each of which holes at least one of said continuous, flexible conductors is passed from said first to said second securing means, each of said holes having an exterior outlet opening with an edge located at or below the outer surface of said outer wall, said at least one conductor being movable across said opening into contact with said edge, over which edge said at least one continuous, flexible conductor is bent as said continuous, flexible electrical conductors are tensioned between said first and second securing means when said missile moves out of said container during launch;

whereby during launch the tensile stresses in each continuous, flexible conductor are combined with the bending stress in each continuous, flexible conductor at the point where said conductor is bent over said edge, thereby producing a concentration of stress at said point sufficient to break said conductors at said point and thus to provide said missile with a smooth outer surface without conductor ends extending beyond said surface following breaking of said conductors.

2. A device according to claim 1, wherein during launch said conductors are straightened under tension to the greatest possible extent and are not bent at any place other than just over said edge of said outlet opening.

3. A device according to claim 2, wherein said missile has a longitudinal axis and said conductors are secured to said missile and said container in such a way that when said missile starts and said conductors are straightened under tension, they form a very small angle to said longitudinal axis of said missile.

4. A device according to claim 3, wherein said missile has an envelope surface and said holes through said insert are drilled at right angles to said envelope surface of said missile.

5. A device according to claim 3, wherein said missile has a forward end and an envelope surface and at least one of said holes through said insert is drilled at an oblique angle to said envelope surface of said missile so that said outlet opening of said hole is farther toward said forward end of said missile than the opening of said hole at the inside of said insert, said hole having a center line which forms an angle to said envelope surface of said missile which is less than 90°.

6. A device according to claim 1, wherein said insert has an outer surface and said missile has an envelope surface, said outer surface of said insert constituting a flush portion of said envelope surface of said missile.

7. A device according to claim 6, wherein said conductors have insulation and said portion of said insert constituting a flush portion of said envelope surface of said missile comprises a recess through the bottom surface of which said holes extend and into which a soft thermosetting plastic has been cast, the surface of said plastic being flush with said envelope surface of said missile, said plastic serving to hide any remnants of said conductor insulation after said conductors have been broken.

8. A device according to claim 1, wherein said holes through said insert are reinforced with metal inserts insulated from each other and located at said exterior outlet opening to provide said edge, whereby said outlet openings of said holes have sharp, hard metal edges which act as cutting edges to break said conductors.

9. A device according to claim 2, wherein said second securing means comprises a thermosetting resin cast around said conductors.

10. A device according to claim 9, wherein said conductors are provided with an enlarged portion in order to prevent the conductors from sliding in said resin.

11. A device according to claim 1, wherein said conductors are made of a comparatively brittle material having a low tensile strength when bent.

12. A device according to claim 11, wherein said conductors have insulation also made of comparatively brittle material.

13. A device according to claim 1, wherein said conductors are of various lengths so that when said missile starts to move forward in said missile container, said conductors are stretched out and broken off successively, whereby the maximum load on said insert need not be more than the breaking stress for one individual electrical conductor.

14. A device according to claim 7, wherein said soft thermosetting resin is arranged to provide a seal gland about said conductors which is airtight both before and after the breaking.

15. A device according to claim 1, wherein said insert is combined with a high frequency filter for said conductors which prevents external high frequency disturbances from being propagated to the inside of the missile.

* * * * *